United States Patent [19]

Imai et al.

[11] 4,419,547

[45] Dec. 6, 1983

[54] IGNITION DISTRIBUTOR FOR INTERNAL COMBUSTION ENGINE

[75] Inventors: Iwao Imai; Masazumi Sone, both of Yokosuka, Japan

[73] Assignees: Nissan Motor Company, Ltd., Yokohama; Hitachi, Ltd., Tokyo, both of Japan

[21] Appl. No.: 346,744

[22] Filed: Feb. 8, 1982

[30] Foreign Application Priority Data

| | | | |
|---|---|---|---|
| Feb. 25, 1981 | [JP] | Japan | 56-25408 |
| Jul. 27, 1981 | [JP] | Japan | 56-116384 |
| Aug. 3, 1981 | [JP] | Japan | 56-120711 |

[51] Int. Cl.[3] ..... H01H 19/00

[52] U.S. Cl. ..... 200/19 R; 200/19 DR; 200/19 DC

[58] Field of Search ..... 200/19 R, 19 DC, 19 DR; 123/633, 632

[56] References Cited

U.S. PATENT DOCUMENTS

| | | | |
|---|---|---|---|
| 2,555,488 | 6/1951 | Hetzler et al. | 200/19 DR X |
| 3,887,780 | 6/1975 | Crim | 200/19 DR |
| 4,039,787 | 8/1977 | Hori et al. | 200/19 DC X |
| 4,135,066 | 1/1979 | Yamanaka et al. | 200/19 DC X |
| 4,217,470 | 8/1980 | Kirner | 200/19 R |
| 4,345,120 | 8/1982 | Sawada et al. | 200/19 DC X |
| 4,349,709 | 9/1982 | Micheli et al. | 200/19 R |

*Primary Examiner*—J. R. Scott

*Attorney, Agent, or Firm*—Schwartz, Jeffery, Schwaab, Mack, Blumenthal & Koch

[57] ABSTRACT

An ignition distributor wherein either a rotor electrode or each of cap electrodes is made of semiconductive alumina ceramics. The semiconductive alumina ceramics contains from 10% to 40% by weight titania ($TiO_2$).

14 Claims, 17 Drawing Figures

IGNITION DISTRIBUTOR FOR INTERNAL COMBUSTION ENGINE

BACKGROUND OF THE INVENTION

1. Field of the Invention

The present invention relates to an ignition distributor for an internal combustion engine and, more specifically to an ignition distributor rotor designed to suppress noise electric wave derived from a discharge between a rotor electrode and each of cap electrodes.

2. Description of the Prior Art

Various studies have shown that one of the sources of motor vehicle noise electric wave radiation is the breakdown of the arc gap between a discharge face of the ignition distributor rotor electrode and each of the circumferentially disposed distributor cap electrodes. The arc gap is generally termed the "distributor gap" and hereinafter will be so referred to.

In an ignition system for a spark ignition internal combustion engine, a large current flows with a steep rise time upon spark discharge within an ignition distributor. The radiation of noise electric wave due to the large current flow disturbs radio broadcasting service, television broadcasting service and other kinds of radio communication systems. Further, noise causes operational errors in electronic control circuits of vehicle control systems, for example, E.F.I. (electronic controlled fuel injection system), E.S.C. (electronic controlled skid control system) or E.A.T. (electronic controlled automatic transmission system), and as a result, traffic safety is threatened. Thus, it is demanded to suppress radiation of the noise from the ignition system.

In operation of the ignition system, a high electric voltage supplied from the ignition coil rises toward its peak not in a step-like manner, but with a time constant determined by the circuit constant. When the voltage rises to a value high enough to cause the breakdown of the distributor gap, the gap is broken down to allow a discharge. In this case, when the level of voltage rises high enough to cause the breakdown of the distributor gap, a discharge current flows rapidly within a short pulse width. The discharge current has a high peak value and very unstable, so that a great deal of toxic high frequency components are generated and noise wave radiates using high tension cables as an antenna.

It is recognized that noise electric field radiating from a source of noise is proportional to a capacity discharge current. Therefore, for the purpose of suppressing noise electric wave, it is necessary to reduce capacity discharge current flowing across the distributor gap. The capacity discharge current occurs when the electric charges accumulated with floating capacity between the rotor electrode and cap electrodes move upon the breakdown of the distributor gap. The capacity discharge current has a high peak value and a steep rising time.

There have been proposed the following countermeasures against the noise radiation from an ignition distributor.

(A) An ignition distributor using a rotor electrode with a resistor:

The rotor electrode having a resistor embedded thereto is called as a "resistor rotor." Because there is a distributed capacity in parallel to the resistor of the distributor rotor, noise radiation within a high frequency band which exceeds 300 MHz is not reduced to a satisfactory level. As the resistor rotor has a resistance of the order of several k ohm, a loss in ignition energy is considerably great.

(B) An ignition distributor wherein the distributor gap between a rotor electrode and each of cap electrodes is wide:

The distributor gap measures from 1.524 mm to 6.35 mm. Although the ignition distributor with the widened distributor gap is effective in suppressing noise radiation, a loss in ignition energy is great. The great loss on the ignition energy is against the recent requirement on the ignition system that the ignition take place securely with a sufficient energy for the purpose of enhancing purification of exhaust gases and fuel economy.

(C) An ignition distributor with a third electrode:

The third electrode is attached to a rotor electrode via a dielectric therebetween. The breakdown of a gap between the third electrode and each of cap electrodes induces the breakdown of a gap between the rotor electrode and each of the cap electrodes. A disadvantage of this ignition distributor is in its complicated structure which causes a less reliable operation after a long use.

SUMMARY OF THE INVENTION

It is an object of the present invention to provide an ignition distributor for an internal combustion engine which is free from the drawbacks encountered in the prior art and suppresses noise radiation to a satisfactory level without any appreciable loss in ignition energy.

In accordance with the present invention, either one of a rotor electrode of an ignition distributor and each of cap electrodes thereof is made of semiconductive alumina ceramics containing a resistance material of alumina ($Al_2O_3$) and a semiconductive material of titania ($TiO_2$).

BRIEF DESCRIPTION OF THE DRAWINGS

For a better understanding of the present invention, reference is made to the following description and accompanying drawings, in which:

FIG. 11 is an exploded view of a rotor electrode used in FIG. 11;

DESCRIPTION OF THE PREFERRED EMBODIMENTS

Figure 1:
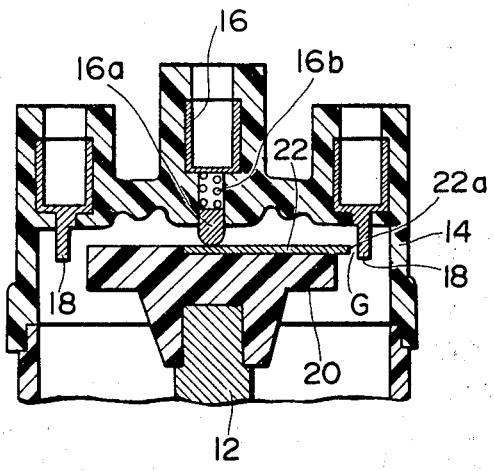
FIG. 1 is a vertical section of a portion of an ignition distributor for an internal combustion engine according to the present invention.

As is well known in the automotive art, the ignition distributor rotor 10 shown in FIG. 1 is rotated by a driving shaft 12, usually gear coupled to the camshaft of the associated internal combustion engine, within a distributor cap 14 having a center input terminal 16 to which is connected one end of the associated ignition coil secondary winding, and a plurality of cap electrodes, two of which are shown at 18, circumferentially disposed about the rotor 10 axis of rotation to which the engine spark plugs are connected through respective spark plug leads. Although only two distributor cap electrodes 18 are shown in FIG. 1, in which the distributor cap 14 is illustrated in cross section, it is to be specifically understood that a cap electrode is provided for each of the engine spark plugs and that they are circumferentially disposed about the center input terminal 16 in a manner well known in the automotive art.

Figure 2:
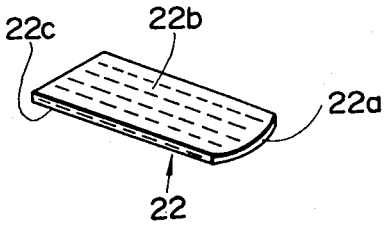
FIG. 2 is a perspective view of a rotor electrode used in FIG. 1.

The ignition distributor rotor 10 comprises a rotor main body 20 of an electrically insulating material adapted to be rotated about the rotor axis of rotation by driving shaft 12 and a rotor electrode 22 supported by the rotor main body 20. Rotor electrode 22 extends in a direction toward and terminates radially inwardly from the circumferentially disposed distributor cap electrodes 18. The cross section surface area of rotor electrode 22 at the extremity thereof nearest the circumferentially disposed distributor cap electrodes 18 defines a discharge face **22*a* which, while rotor electrode 22 is rotated with rotor main body 20, traces a circular path radially inwardly from the circumferentially disposed distributor cap electrodes 18 by a predetermined distributor gap G. As shown in FIG. 2, top and bottom flat face surfaces 22*b* and 22*c* define, at the extremities thereof nearest the circumferentially disposed distributor cap electrodes the top and bottom edge boundaries of the discharge face 22*a*. The rotor electrode 22 as shown in FIG. 2** is made of semiconductive alumina ceramics only.

Rotor electrode 22 is of a sufficient length to electrically contact center input terminal 16 through a center electrode **16*a* and an electrically conductive spring 16*a* that biases the center electrode 16*a* into contact with the rotor electrode 22**.

With this arrangement, the ignition spark potential produced by the secondary winding of the associated ignition coil may be delivered to successive ones of the circumferentially disposed distributor cap electrodes 18 as rotor main body 20 is rotated by shaft 12 in timed relationship with an associated internal combustion engine in a manner well known in the automotive art. This circuit may be traced through center input terminal 16, rotor electrode 22 and the distributor gap G between the discharge face **22*a* and each of the distributor cap electrodes 18**.

Figure 3:
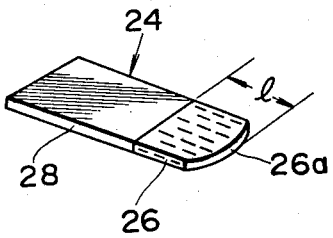
FIG. 3 is a second embodiment of a rotor electrode according to the present invention.
Figure 4:
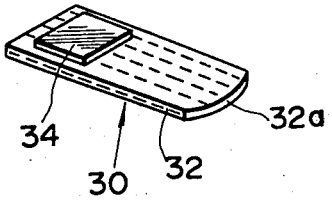
FIG. 4 is a third embodiment of a rotor electrode according to the present invention.

Referring to FIGS. 3 and 4, two other forms of rotor electrodes are illustrated. A rotor electrode 24 illustrated in FIG. 3 includes a tip portion 26, formed with a discharge face **26*a*, made of a semiconductive alumina ceramics and a center portion 28 made of a wear resistant metal. The center portion 28 has a surface area at which it contacts a center carbon 16*a*. A rotor electrode illustrated in FIG. 4 includes an elongate plate 32 made of semiconductive alumina ceramics and a plate 34 made of wear resistant metal. The elongate plate 32 is substantially the same in configuration as the rotor electrode 22 shown in FIG. 2 and is formed with a discharge face 32*a*. The metal plate 34 is secured to the elongate plate 32 and has a surface area at which it contacts a center carbon 16*a***.

Figure 5:
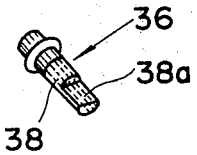
FIG. 5 is a perspective view of a cap electrode, which may be used as each of cap electrodes in the ignition distributor shown in FIG. 1.

Referring to FIG. 5, another form of a cap electrode 36 is illustrated which has a tip portion 38 formed with a discharge face **38*a*** and made of semiconductive alumina ceramics.

Nextly, an explanation is made as to a method for manufacturing the semiconductive alumina ceramics.

Firstly, prepare a powder obtained by pyrolysis of alumina salt, such as, aluminium hydroxide, or prepare an alumina powder obtained by calcinating aluminium salt. The powder is mixed with a binder in the form of magnesium (MgO) or silica ($SiO_2$) or calcia (CaO) and is added thereto by a small amount of titania ($TiO_2$). After being mixed well with each other, the mixture is formed into a tape. The shape of an electrode is formed out of the tape by blanking. The electrode is sintered within an oxygen atmosphere at a temperature above 1200° C. The titania is used as an additive to give an electric conductance to the sintered body, but, at this stage of process, the sintered body does not have any electric conductivity. The sintered body is reduced within a nitrogen reducing atmosphere including hydrogen at a temperatures falling within a range from 1300° to 2000° C. for a time ranging from about 10 to 48 hours. As a result, an alumina ceramics having semiconductive property is obtained.

It explains the semiconductivity of the alumina ceramics mentioned as above that the reduction has caused $TiO_2$ to make a semiconductor. The conductance is adjustable to some extent by changing a degree in reduction which is dependent upon the temperature of the atmosphere and a treating time. It is known that titania ($TiO_2$) has a stoichiometric structure which is easily deviatable and thus it is easily reducable. $TiO_2$ is deprived of oxygen ions as a result of the reduction, allowing excess electrons to gain mobility and act as if they were electrons within a crystal of a metal. This is one of the explanations why $TiO_2$ has made a semiconductor as a result of the reduction. Another explanation is that if an ion having valence electrons more than and including five (5), such as a pentavalent ion like $Sb^{5+}$, is contained as impurity in the ceramics, a tetravalent ion $Ti^{4+}$ is forced to become a trivalent ion $Ti^{3+}$ to satisfy the electrical neutrality condition in the lattice. Thus, the same effect as that which would be resulted from the reduction is given to the ceramics.

The semiconductive alumina ceramics is thought to have a structure composed of a high resistance element of alumina, a semiconductive solid solution element of alumina and titania and a semiconductive element of titania which are mixed with each other and dispersed.

Electric property of semiconductive ceramics is dependent upon the amount of titania and/or treatment conditions during reduction.

The use of the semiconductive alumina ceramics as the rotor electrode and/or each of the cap electrodes of an ignition distributor is very effective in suppressing noise. One of the reasons is that the microscopic structure of the discharge face of each electrode is composed of finely subdivided conductive element and high resistance element. The other reason is that, viewing the structure as macro, each electrode has an electric resistance.

A precise explanation will follow as to why the use of semiconductive alumina ceramics as an electrode is effective in suppressing noise.

The following two effects appeared to be good explanations.

(1) The semiconductance of the material of the electrode viz., the electric resistance thereof, cooperates with a static floating capacity with respect to the earth to form a R-C filter, resulting in that capacity discharge current rises at a slow rate.

(2) Since the discharge face of the electrode is composed of subdivided titania ($TiO_2$) having a high conductance and alumina ($Al_2O_3$), having a high resistance, Pre Ignition effect of Malter effect is thought to take place.

Speaking of Pre Ignition effect, it is a phenomenon in which space charges are captured by each of the rotor and cap electrodes of an ignition distributor on the high resistance layer on the surface of each electrode owing to the electro static force. The captured space charges establish a high electric field between the electrode surfaces, thus causing a discharge between the rotor electrode and cap electrode to take place prior to the occurrence of the primary discharge, lowering the magnitude of the breakdown voltage, viz., a voltage at which discharge is initiated.

Malter effect is a phenomenon in which a metallic conductor with a non-conducting surface film has a large coefficient of electron emission; thus since the negative electrode has a large coefficient of electron emission, the breakdown voltage, viz., a voltage at which a discharge is initiated, drops.

Figure 6:
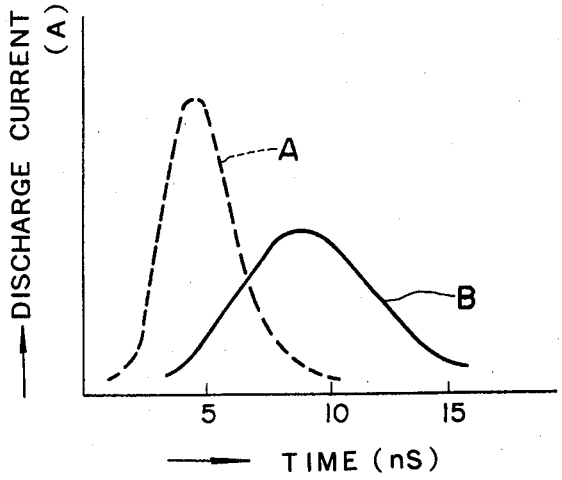
FIG. 6 is a discharge current vs., time characteristic for the ignition distributor embodying the present invention and that for a conventional ignition distributor using a copper rotor electrode and aluminum cap electrodes.
Figure 7:
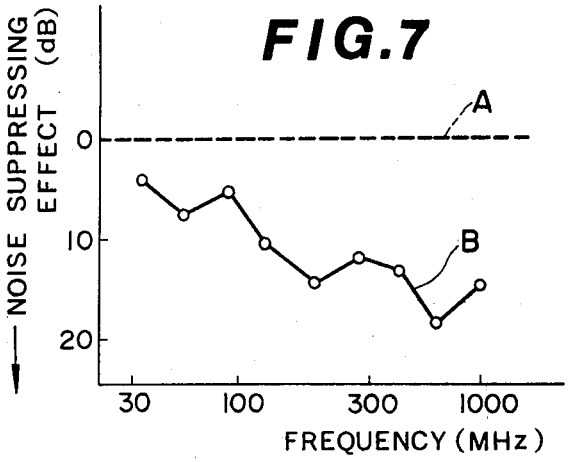
FIG. 7 is a noise suppressing effect vs., frequency characteristic for the ignition distributor incorporating the present invention with the noise level at each frequency of the conventional ignition distributor taken as 0 dB (zero decibel)

The validity of the discussions can be confirmed from observations of test results shown in FIGS. 6 and 7. To clarify the effects provided by the invention, a conventional ignition distributor was also tested and the results were plotted in FIGS. 6 and 7.

FIG. 6 is a graph showing a discharge current across the distributor gap versus time characteristic (solid line curve B) of an ignition distributor according to the present invention and that (broken line curve A) of a conventional ignition distributor. In this Figure, time is taken as abscissa and discharge current as ordinate. As the conventional ignition distributor, one having a rotor electrode of copper and cap electrodes of aluminium was used. As the ignition distributor according to the present invention, one having a rotor electrode of semiconductive alumina ceramics and another wherein both rotor and cap electrodes were made of semiconductive alumina ceramics were used. The difference of the result of the test of the former from that of the latter was negligibly small, so that they were represented by the single characteristic curve B.

As shown by the broken line curve A, a pointed peak wave having a high pointed peak value appeared in the conventional ignition distributor, meaning that a big current has flown within a short time. In the ignition distributor according to the present invention, the solid line curve B clearly shows that the discharge current rises at a slow rate and has a lower peak value. Comparison of these two curves A and B shows that the noise electric wave has been suppressed effectively in the ignition distributor according to the present invention.

Strength in electric field of noise electric wave versus frequency was measured for a motor vehicle when installed with the conventional ignition distributor and the motor vehicle when installed with the ignition distributor according to the present invention. The measurement results were represented in FIG. 7 wherein frequency is taken as abscissa and noise reduction effect as ordinate.

The strength in electric field of the motor vehicle when installed with the conventional ignition distributor is taken as base value of 0 dB and shown by a broken line curve A. The difference of the strength in noise electric field for the motor vehicle when installed with the conventional ignition distributor from that for the motor vehicle installed with the ignition distributor according to the present invention was calculated at any given frequency and plotted in FIG. 7 as shown by a solid line curve B. From the graph shown in FIG. 7, it will be understood that the noise reduction effect of the order of from 10 dB to 15 dB over a frequency range from 30 MHz to 1000 MHz has been obtained.

Measurement has been made to determine the magnitude of breakdown voltage of the conventional ignition distributor and that of the ignition distributor according to the present invention. The magnitude of breakdown voltage of the conventional ignition distributor was about 12 kV, while, that of the ignition distributor according to the present invention was about 5 to 8 kV. Therefore, an appreciable drop in the breakdown voltage has been accomplished according to the present invention. It was confirmed from the measurement of voltage across the distributor gap during the induction discharge and of time period during which the induction discharge continued that there was substantially no difference in these respects between the conventional ignition distributor and the ignition distributor according to the present invention. The magnitude of the voltage across the distributor gap during the induction discharge was the sum of a voltage drop due to resistance of electrode and a voltage drop due to induction discharge.

Experiments showed that the ignition distributor according to the present invention was superior in a noise suppressing effect to the conventional ignition distributor and a loss in ignition energy as compared to the conventional ignition distributor was too small to create a problem.

It is known that with the conventional ignition distributor, intermittent discharge which takes place during induction discharge interfers with FM radio. The ignition distributor according to the present invention was free from the interference problem with FM radio because no intermittent discharge appeared. It appears that this effect is derived from the micro structure of the discharge face of the electrode which is made of semiconductive alumina ceramics and from the resistance given to the electrode by semiconductive alumina ceramics.

As previously described, the use of the semiconductive alumina ceramics as a rotor electrode and/or cap electrodes provides electric resistance to the electrode, Pre Ignition effect and Malter effect which cooperate with each other to suppress noise electric wave.

It was found that the amount of titania contained in the semiconductive alumina ceramics was closely related with the magnitude of loss in ignition energy.

The amount of addition of titania ($TiO_2$) substantially agreed with the amount of titania contained in the semiconductive alumina ceramics which was determined by composition analysis. It was also confirmed that a very small amount of titania existed in the form of alumina titania solid solution and alumina was alpha-alumina and titania formed a rutile structure.

Relationship of the amount of addition of titania to the starting material, viz., alumina powder, of semiconductive alumina ceramics with adaptability as a rotor electrode is shown in the following Table.

TABLE

| Titania (% by weight) | Ti (% by weight) | Noise suppressing effect as compared to copper rotor (dB) | Difference in performance from copper rotor |
|---|---|---|---|
| 0 (Alumina only) | 0 | — | Incapable to ignite |
| 3 | 1.4 | — | |
| 5 | 2.4 | — | Large energy loss |
| 10 | 4.8 | 5 ~ 10 | Small energy loss |
| 15 | 7.3 | 10 ~ 12 | No significant difference |
| 20 | 9.8 | 10 ~ 12 | |
| 30 | 15 | 8 ~ 10 | |
| 40 | 27 | 5 ~ 10 | |
| 50 | 26 | 2 | |
| 70 | 39 | 0 | |
| 100 (Titania only) | 60 | 0 | |

In the Table, the mean values over a frequency range from 45 to 1000 MHz were taken as noise suppressing effect, and the tabulated values were obtained by test of the ignition distributor using a rotor electrode as shown in FIG. 3. The rotor electrode having the tip portion with a length 1 of 10 mm was used.

As will be readily understood from the Table, as long as the amount of addition of titania is within a range from 10 to 40% by weight (corresponding to a range of titan from about 5 to 20% by weight), the noise suppressing effect is great and a loss in ignition energy is small as much as the copper rotor. Therefore, the semiconductor alumina ceramics is best suited for the material of electrodes.

It will be understood that the use of semiconductive alumina ceramics produced from a starting material including alumina powder with 10 to 40% by weight titania has proved to be best suited for the material of electrodes because noise electric wave has been suppressed with an ignition energy loss small as much as that of a copper electrode. Also it also proved to be endurable because no heat loss was found on the discharge face of the rotor electrode and no degradation in noise suppressing effect was found after continuous discharge endurability test conducted for a long time.

Since the surface state of discharge face of the electrode plays a main role in suppressing noise electric wave, it is no more necessary to employ a long electrode.

A difference in noise suppressing effect was noted between the use of an electrode produced by machining the shape of the electrode out of a sintered body alumina ceramics containing titinia and the use of an electrode produced by forming the shape of the electrode by blanking before sintering. The result was that the electrode produced by the latter manufacturing method showed a better noise suppressing effect.

The shape of a rotor electrode can be formed using a forming method by blanking which has been established for manufacturing method for a rotor electrode of alumina ceramics, viz., a manufacturing method wherein the shape of a rotor electrode is formed by blanking and is subsequently sintered, thus being best suited for means production and for manufacture at low cost.

Figure 8:
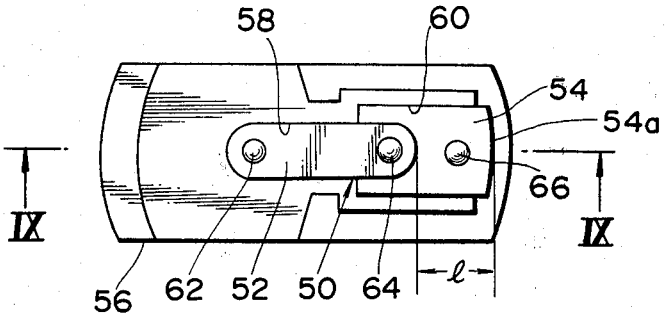
FIG. 8 is top plan view of a rotor of an ignition distributor.
Figure 9:
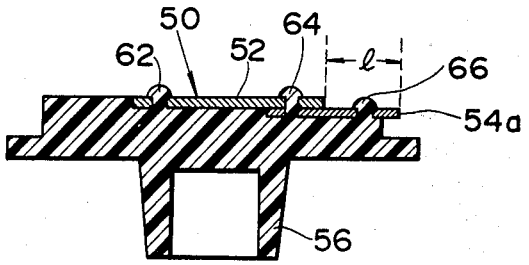
FIG. 9 is a cross section through the line IX—IX in FIG. 8.

Referring to FIGS. 8 and 9, another embodiment of the present invention is illustrated which has been devised to solve a problem that a center carbon 16*a* (see FIG. 1) wears at a fast rate if the center carbon 16*a* is held in direct contact with semiconductive alumina ceramics which has a rough surface.

In FIGS. 8 and 9, a rotor electrode 50 includes a center plate 52 made of wear resistant metal like copper or stainless steel and a tip plate 54 made of semiconductive alumina ceramics.

A rotor main body 56 of electrically insulating material is formed with grooves 58 and 60 for receiving the center plate 52 and tip plate 54. It is also formed with protuberances 62, 64 and 66 for inserting into holes with which both of the plates 52 and 54 are formed. In assembly, the center and tip plates 52 and 54 are placed within the corresponding grooves 58 and 60 with their holes receiving the corresponding protuberances 62, 64 and 66 and are subsequently fixed to the rotor main body 56 by enlarging heads of the protuberances 62, 64 and 66 by a supersonic staking method. The center plate 52 and tip plate 54 are overlapped one on the other to establish an electrical contact with each other.

The above-mentioned structure has the following effects:

Since the center plate 52 with which the center carbon 16*a* (see FIG. 1) contacts is made of wear resistant metal, the rate at which the center carbon 16*a* wears has decreased. Since the tip plate 54 which has a discharge face 54*a* is made of semiconductive alumina ceramics, satisfactory noise suppression effect has been accomplished.

Since this structure permits free setting of an actual length 1 of the semiconductive alumina ceramics (length of radially protruding section of the tip portion from the center portion), it is easy to set the actual length 1 to an optimum value determined on the standpoints of noise suppressing effect and ignition energy loss.

Experimentally, it was determined that the actual length 1 be set to a value within a range from 3 mm to 15 mm. Experiments revealed that as long as the actual length 1 was shorter than about 15 mm it did not show any significant inferiority to the use of a conventional copper rotor in ignition energy loss and in ignition performance which were supposedly to appear owing to the resistance of semiconductive alumina ceramics. (More precise description will be made later). However, if the length 1 was shorter than 3 mm, discharge began to take place between the center plate and the cap electrodes, thus decreasing the noise suppressing effect.

According to the assembly method mentioned above, the semiconductive alumina ceramics did not receive a pressure which would be the case in the conventional method of fixing a rotor electrode to a rotor main body by moulding, thus providing an easy to assemble method which is free from the possibility that the tip portion of semiconductive alumina ceramics might break during moulding.

Referring to FIGS. 14, 14A, 15 and 15A, a loss in ignition energy which is inherent to the ignition distributor according to the present invention is specifically explained hereinafter.

Figure 14A:
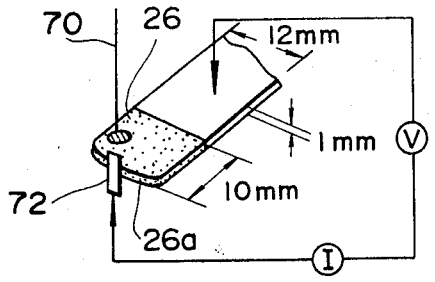
FIG. 14A is a view showing a circuit arrangement used to obtain test results shown in FIG. 14.
Figure 14:
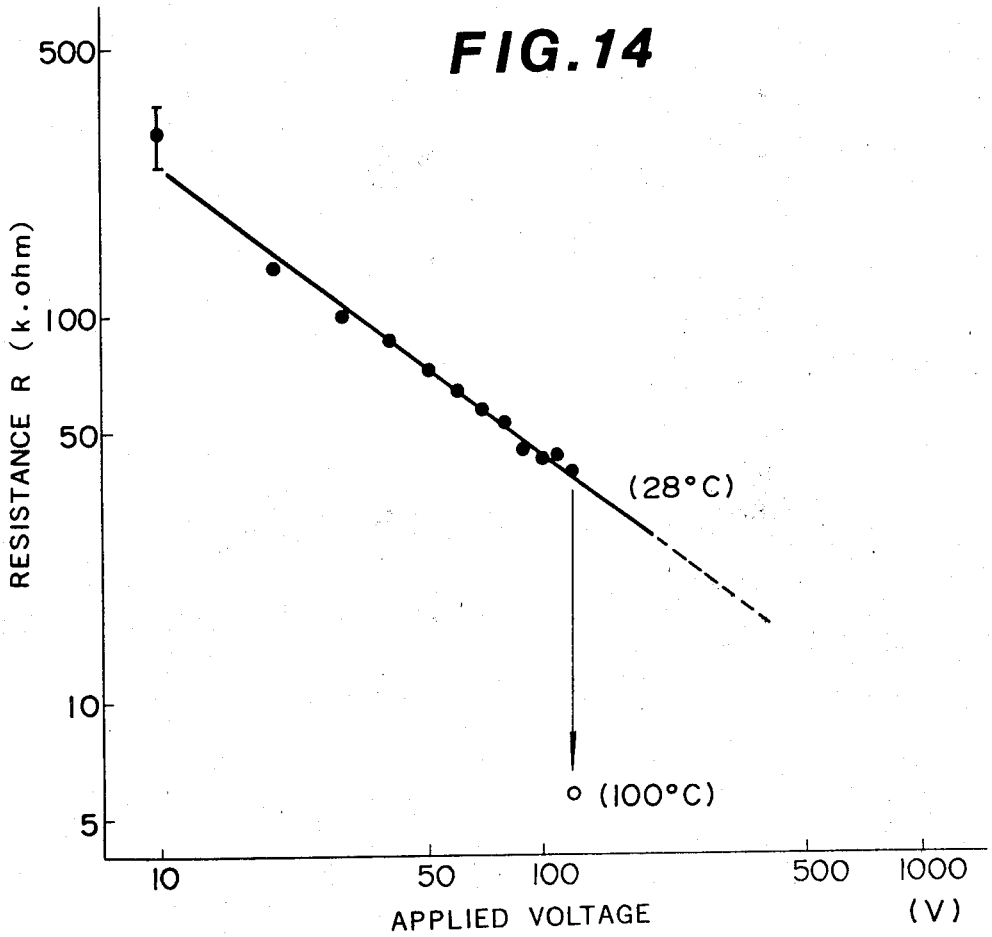
FIG. 14 is a resistance vs., voltage characteristic for a rotor electrode shown in FIG. 14A.

FIG. 14 shows results of conducted with a test arrangement shown in FIG. 14A wherein a rotor electrode with a tip portion of semiconductive alumina ceramics having a length of 10 mm, a width of 12 mm and a thickness of 1 mm (see FIG. 14A) was used. In FIG. 14A, a temperature probe and a contact electrode are denoted by 70 and 72, respectively. When temperature of the tip portion of the rotor electrode was 28° C., a resistance of the order of several k.ohm was obtained when 10 V was applied. When 100 V was applied, 40 k.ohm was obtained. Thus, the resistance R decreases as shown in FIG. 14 with increasing voltage, showing a relationship that the resistance R was inversely proportional to voltage.

Figure 15A:
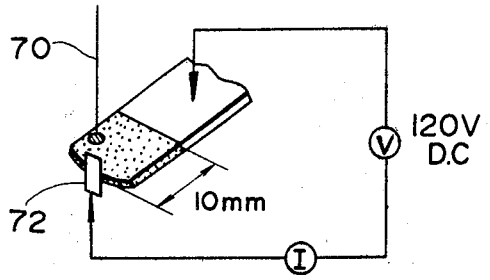
FIG. 15A is a view showing a circuit arrangement used to obtain results shown in FIG. 15.
Figure 15:
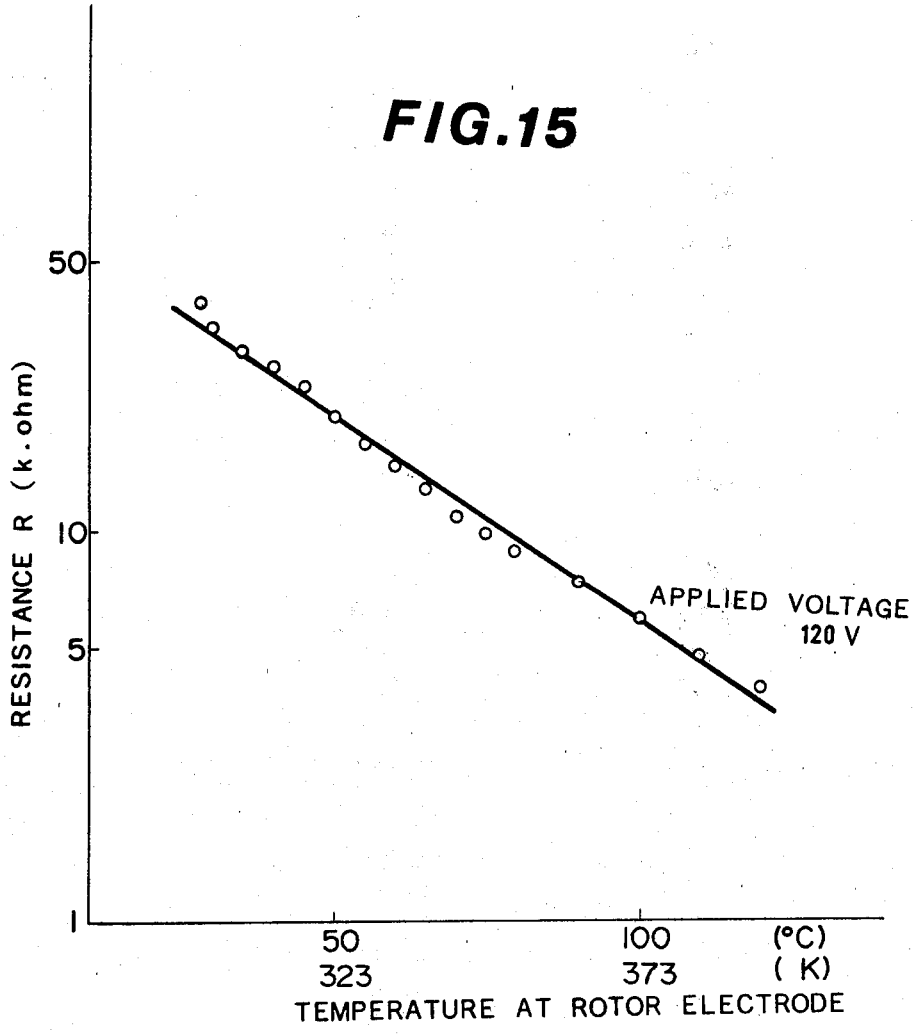
FIG. 15 is a resistance vs., temperature characteristic for a rotor electrode shown in FIG. 15A.

FIG. 15 shows with test results obtained with the applied voltage at constant of 120 V (see FIG. 15A) and shows a resistance vs., temperature characteristic.

If the temperature on the tip portion increases up to about 100° C., a rapid drop in resistance was noted as shown in FIG. 15.

From consideration of voltage dependence of resistance and temperature dependence thereof, it can be deduced that the resistance of rotor electrode drops to the order of several k.ohm during induction discharge when the electrode temperature is of the order of several hundred degrees centigrades since the applied voltage is in the vicinity of 200 V. It will therefore be appreciated that since the resistance is of the order of several k.ohm, a loss in ignition energy due to the resistance is very small. Thus, this is a good explanation of no significant difference in voltage between the rotor and cap electrodes during induction discharge and in discharge time between the ignition distributor according to the present invention and the conventional ignition distributor using copper electrode.

Figure 10:
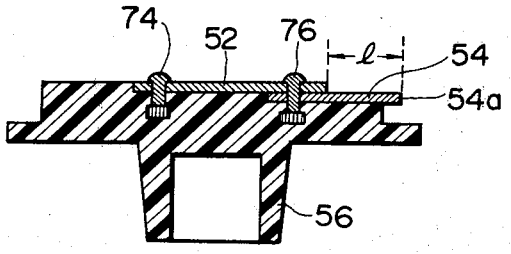
FIG. 10 is a similar view to FIG. 10 illustrating another rotor.

Referring to FIG. 10, a modification of the rotor as shown in FIGS. 8 and 9 is illustrated.

In this embodiment, rivets 74 and 76 (grommets are substitutes) and a rotor main body 56 are formed integrally during moulding the rotor main body 56. With the rivets 74 and 76, center and tip plates 52 and 54 are fixed to the rotor main body 56.

Figure 11:
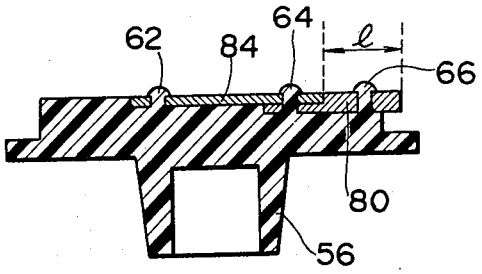
FIG. 11 is a similar view to FIG. 9 illustrating still another rotor.
Figure 12:
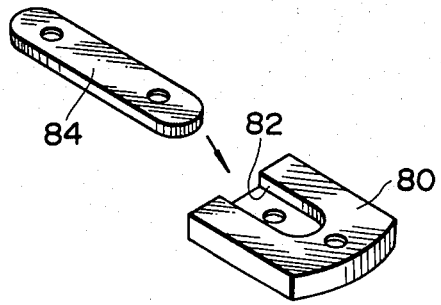

FIGS. 11 and 12 illustrate another rotor, wherein a tip plate 80 is formed with a groove 82 at a portion adapted to be overlapped by a center plate 84, so as to receive the end portion of the center plate 84. In assembly, the end of the center plate 84 is inserted into the groove 82 of the tip plate 80 and then they are fixed to a rotor main body 56 in a manner similar to a method described in connection with FIGS. 8 and 9.

The groove thus formed in the tip plate 80 is effective in making it easy to locate relative position of the tip plate 80 relative to the center plate 84.

Figure 13:
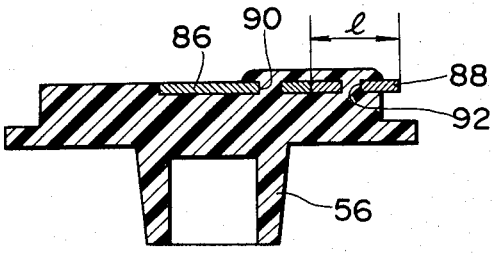
FIG. 13 is a similar view to FIG. 9 illustrating another rotor.

Referring to FIG. 13, still another rotor is described.

In this embodiment, after arranging a center plate 86 and a tip plate 88 along a radial direction with their adjacent ends contacting with each other on a rotor main body 56, the same resin as the material for the rotor main body 56 is forced to flow into holes 90 and 92 formed in the center and tip plates 86 and 88. In this manner, the center and tip plates 86 and 88 are fixed to the rotor main body 56. Since the semiconductive alumina ceramics is strong and less liable to crack, the center and tip plates 86 and 88 may be moulded integral with the rotor main body 56 during moulding of the rotor main body.

If a method is employed to mould the center and tip plates 86 and 88 integrally with the rotor main body 56, the shaking step which otherwise would be necessary can be eliminated and the fixing of the rotor electrode can be accomplished during the moulding process of the rotor main body.

It will be appreciated that if that portion of a rotor electrode which contacts with a center carbon is formed of wear resistant metal, while, the remaining portion of the center electrode, i.e., a tip portion, formed of semiconductive alumina ceramics, and the length of the tip portion is set to have an optimum value falling in a range from 3 mm to 15 mm and the center and tip plates are fixed to the rotor main body in a simple manner as disclosed in the various embodiments shown in FIGS. 8 to 13, satisfactory noise suppressing effect, reduction in wear rate of a center carbon, and easy assembly are accomplished once for all.

What is clamed is:

1. In an ignition distributor for an internal combustion engine comprising:

a distributor cap;

an ignition distributor rotor rotatable about its axis within said distributor cap;

said distributor cap having a center electrode extending along the rotor axis of rotation and a plurality of cap electrodes circumferentially disposed about the rotor axis of rotation;

said ignition distributor rotor comprising a rotor main body of an electrically insulating material rotatable about the rotor axis of rotation and a rotor electrode supported by said rotor main body;

said rotor electrode having a discharge face which, when said ignition distributor rotor is rotated with said rotor main body, traces a circular path inwardly from the circumferentially disposed distributor cap electrodes by a predetermined distributor gap, said rotor electrode having a surface area in contact with said center electrode;

the improvement wherein either said rotor electrode or each of said cap electrodes is made of semiconductive alumina ceramics comprising a resistance element of alumina and a semiconductive element of titania.

2. An ignition distributor as claimed in claim 1, wherein said semiconductive alumina ceramics includes from 10% to 40% by weight of titania ($TiO_2$).

3. An ignition distributor as claimed in claim 1 or 2, wherein said rotor electrode is made of said semiconductive alumina ceramics only.

4. An ignition distributor as claimed in claim 1 or 2, wherein said rotor electrode includes a tip portion formed with said discharge face and a center portion formed with said surface area in contact with said center carbon, said tip portion being made of said semiconductive alumina ceramics only, said center portion being made of wear resistant metal only.

5. An ignition distributor as claimed in claim 1 or 2, wherein said rotor electrode includes a first plate formed with said discharge face and a second plate formed with said surface area in contact with said center carbon and secured onto said first plate, said first plate being made of said semiconductive alumina ceramics only, said second plate being made of wear resistant metal only.

6. An ignition distributor as claimed in claim 1 or 2, wherein said rotor electrode includes a tip plate formed with a discharge face and a center plate formed with said surface area in contact with said center carbon, said tip plate being in electrical contact with said center plate and protruding from said center plate such that a distance from said discharge face to said center plate along a radial direction from the rotor axis of rotation falls within a range from 3 mm to 15 mm.

7. An ignition distributor as claimed in claim 6, wherein said rotor main body is formed with grooves receiving said center and tip plates, respectively, and a plurality of protuberances disposed within said grooves, said center and tip plates being formed with holes receiving said protuberances, said protuberances having heads enlarged by staking to fix said center and tip plates onto said rotor main body.

8. An ignition distributor as claimed in claim 7, wherein said center plate overlaps said tip plate.

9. An ignition distributor as claimed in claim 8, wherein said protuberances are moulded upon moulding said rotor main body.

10. An ignition distributor as claimed in claim 8, including rivets fixedly embedded to the bottom surfaces of said grooves, said rivets protruding outwardly from the bottom surfaces of said grooves and defining said protuberances.

11. An ignition distributor as claimed in claim 8, wherein said tip plate is formed with a groove to receive an end portion of said center plate.

12. An ignition distributor as claimed in claim 6, wherein said tip and center plates are formed with holes receiving the same molding material as that used for forming the rotor main body.

13. An ignition distributor as claimed in claim 1 or 2, wherein said semiconductive alumina ceramics is formed by preparing one power of a powder ($Al_2O_3$) obtained by pyrolysis of aluminium hydroxide and an alumina powder obtained by calcinating aluminium salt, mixing said powder with a binder in the form of one of magnesium (MgO), silica ($SiO_2$) and calcia (CaO) and with an additive of titania ($TiO_2$), forming the shape of electrode from the mixture, sintering the mixture having the shape of electrode within an oxygen atmosphere at a temperature above 1200° C., and reducing the sintered body having the shape of electrode within an nitrogen reducing atmosphere including hydrogen at a temperature falling within a range from 1300° to 2000° C. for a time from about 10 to 48 hours.

14. In an ignition distributor for an internal combustion engine comprising:

a distributor cap;

an ignition distributor rotor rotatable about its axis within said distributor cap;

said distributor cap having a center electrode extending along the rotor axis of rotation and a plurality of cap electrodes circumferentially disposed about the rotor axis of rotation;

said ignition distributor rotor comprising a rotor main body of an electrically insulating material rotatable about the rotor axis of rotation and a rotor electrode supported by said rotor main body;

said rotor electrode including a tip plate formed with a discharge face which, when said ignition distributor rotor is rotated with said rotor main body, traces a circular path inwardly from the circumferentially disposed distributor cap electrodes by a predetermined distributor gap, said rotor electrode also including a center plate in contact with said center electrode, said tip plate protruding from said center plate, the improvement wherein said tip plate is made of semiconductive alumina ceramics comprising a resistance element of alumina and a semiconductive element of titania ($TiO_2$), said semiconductive alumina ceramics containing from 10% to 40% by weight titania, and said tip plate is a rectangular elongate plate which protrudes from said center plate along the rotor axis of rotation by a distance falling within a range from 3 mm to 15 mm.

* * * * *